United States Patent [19]

Sarto

[11] 4,137,880

[45] Feb. 6, 1979

[54] TIME DELAY APPARATUS FOR AN EXHAUST GAS RECIRCULATION CONTROLLER

[75] Inventor: Jorma O. Sarto, Orchard Lake, Mich.

[73] Assignee: Chrysler Corporation, Highland Park, Mich.

[21] Appl. No.: 848,069

[22] Filed: Nov. 3, 1977

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,739,797 | 6/1973 | Caldwell | 123/119 A |
| 3,818,880 | 6/1974 | Dawson et al. | 123/119 A |
| 3,977,381 | 8/1976 | Fujikawa et al. | 123/119 A |
| 3,996,905 | 12/1976 | Dawson | 123/119 A |

*Primary Examiner*—John J. Vrablik
*Assistant Examiner*—R. E. Gluck
*Attorney, Agent, or Firm*—Baldwin & Newtson

[57] ABSTRACT

Time delay valve means are provided in a conduit through which an actuating vacuum signal is supplied to a valve for controlling the recirculation of exhaust gases in an internal combustion engine. The time delay valve means include a pressure responsive vacuum relay valve for opening and closing the conduit in response to an increase in engine intake manifold vacuum to a predetermined level and an orifice for increasing the time required after engine starting for the predetermined level of intake manifold vacuum to be applied to the vacuum relay valve.

10 Claims, 2 Drawing Figures

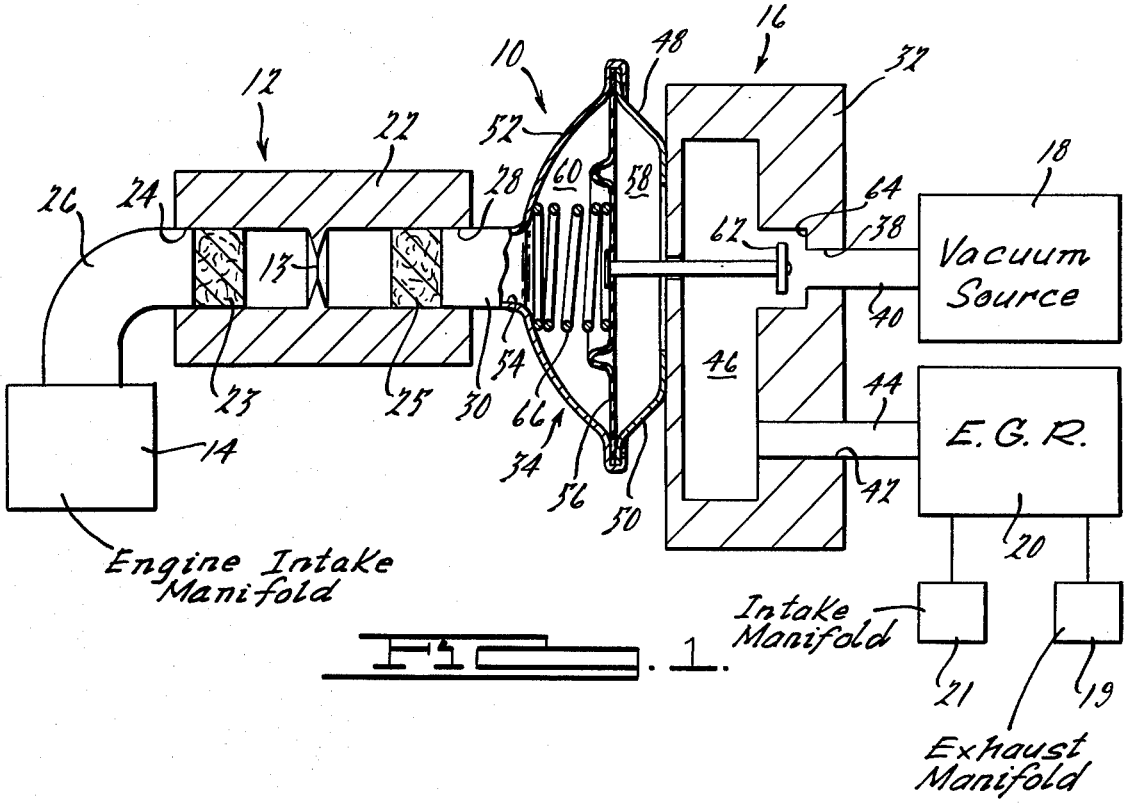
FIG. 1.
FIG. 2.
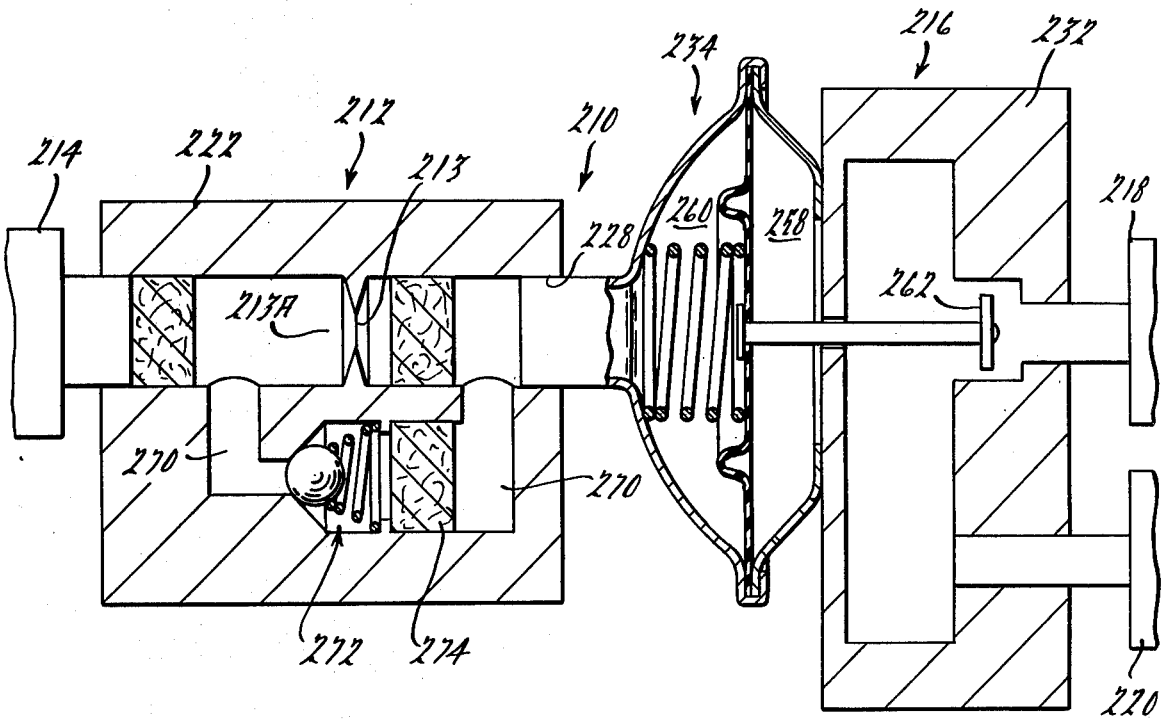

TIME DELAY APPARATUS FOR AN EXHAUST GAS RECIRCULATION CONTROLLER

BACKGROUND OF THE INVENTION

1. Field of Invention

The invention relates generally to vacuum operated valves and more specifically to a time delay valve for controlling operation of an exhaust gas recirculation controller.

2. Description of the Prior Art

The use of exhaust gas recirculation (EGR) valves to reduce undesirable exhaust emissions in automotive internal combustion engines has become widespread. While many different valves are available, most are similar in the respect that they utilize a vacuum signal representative of air flow into the engine to actuate the valve to permit the recirculation of exhaust gases. This signal is typically either taken at the carburetor throttle valve whereat it is generally referred to as ported vacuum and transmitted directly to the EGR valve or at the carburetor venturi and amplified to a level sufficient to operate the EGR valve.

In either case a somewhat undesirable transient condition exists during and shortly after starting the engine in that the immediate application of a vacuum signal to the EGR valve from the carburetor throttle valve or venturi can result in the recirculation of exhaust gases during this time period. This recirculation tends to delay the stabilization of combustion and of engine operating temperature upon starting, thereby burdening the starting cycle and causing undue wear of engine components.

It is therefore considered advantageous to delay the operation of the EGR valve until after the start cycle is complete. In accomplishing this delay, however, it is desirable that the means employed to effect the delay be inoperative during normal engine operation. It is also desirable that this time delay for EGR valve operation during starting also be capable of rapid repetitive operation to accommodate quick restarting of an engine without actuation of the EGR valve.

To accomplish these desirable functions prior art exhaust gas recirculation systems have uneconomically employed relatively expensive engine condition transducers and solenoid operated valves.

SUMMARY OF THE INVENTION

It is therefore a principal object of this invention to provide simple, economical means for delaying the application of actuating vacuum to an exhaust gas recirculation valve of an automotive internal combustion engine until after the starting of the engine.

It is another object to provide such simple, economical delay means which are inoperative during operation other than starting of the engine.

It is yet another object to provide such a delay means which permit rapid repetitive operation.

These and other objects of the invention will become apparent upon reading the following detailed description and claims with reference to the accompanying drawings of a time delay apparatus comprising a vacuum relay valve having a pressure responsive member for opening the valve to permit application of a vacuum signal to the EGR valve upon sensing a build-up of intake manifold vacuum to a predetermined level and a time delay orifice disposed fluidly intermediate the engine intake manifold and the pressure responsive member for delaying the vacuum build-up. In one embodiment of the invention valve means are provided to permit closing of the relay valve immediately upon stopping the engine.

BRIEF DESCRIPTION OF THE DRAWINGS

In the drawings:

FIG. 1 is a diagrammatic view of the time delay apparatus of the present invention; and FIG. 2 is a diagrammatic view similar to FIG. 1 of an alternative embodiment of the time delay apparatus of the present invention.

DESCRIPTION OF THE PREFERRED EMBODIMENTS

The FIG. 1 Embodiment

Referring first to FIG. 1 a vacuum time delay apparatus 10 is shown as comprising an orifice assembly 12 connected fluidly in series with a vacuum source 14 and a vacuum relay valve assembly 16. The vacuum relay valve assembly 16 is also in fluid communication with a vacuum source 18 and an EGR valve vacuum motor 20.

The vacuum source 14 is in all cases a source of engine intake manifold vacuum, but the vacuum source 18 may be either a source of vacuum adjacent of the carburetor throttle plate (commonly referred to as "ported vacuum") or a source of vacuum adjacent the carburetor venturi. In the latter case the EGR vacuum motor designated 20 includes a vacuum amplifier which multiplies the signal by a factor of approximately 10 to 14 to achieve a signal level in the order of that required for EGR operation to permit the recirculation of exhaust gas from an engine exhaust manifold 19 to an engine intake manifold 21. Since both approaches are well known in the art, no further description of the exhaust gas recirculation actuation scheme per se is deemed necessary. It will be clear as the description progresses that the source or magnitude of the vacuum signal used to actuate the engine's EGR valve forms no part of the present invention.

The orifice assembly 12 is illustrated diagrammatically as including a housing 22 having a signal port 24 connected to the vacuum source 14 by a conduit 26 and an actuator port 28 connected to the relay valve assembly 16 by a conduit 30. A fixed orifice 13 is carried in the housing 22 intermediate protective filters 23, 25.

Relay valve assembly 16 is illustrated as including a valve housing 32 and a pressure responsive valve assembly 34. The valve housing 32 includes an outlet port 38 fluidly connected to the vacuum source 18 by a conduit 40 and an inlet port 42 fluidly connected to the vacuum motor 20 by a conduit 44. A chamber 46 is formed in the housing 32 interconnects the outlet and inlet ports 38, 42.

The pressure responsive valve assembly 34 includes a base housing 48 fixedly secured to the valve housing 32 and having apertures 50 formed through it for communication with atmosphere, and a control housing 52 secured to the base housing 48 and including a port 54 connected to the conduit 30.

A pressure responsive member illustrated diagrammatically as a diaphragm 56 is clampingly secured between the base housing 48 and the control housing 52 thereby defining an atmospheric chamber 58 and a control chamber 60. A valve member such as the poppet valve 62 is carried by the diaphragm 56 and extends slidingly through the valve housing 32 to be axially moveable with respect to a seat 64 for effecting opening and closing of the valve housing inlet port 38. A spring 66, grounded between the control housing 52 and the diaphragm 56, normally urges the poppet valve 62 to the closed position. The assembled load and rate of the spring 66 are chosen so that the level of manifold vacuum present during all normal operating conditions is sufficient to hold the poppet valve 62 in its open position.

The vacuum delay apparatus 10 of FIG. 1, then, operates in the following manner to delay the operation of an EGR valve during engine starting.

It can be assumed that with the engine (not shown) at rest all portions of the time delay apparatus 10 are at atmospheric pressure. As the engine is started, however, the vacuum level in conduits 26 and 40 increase relatively rapidly as air (in air/fuel mixture) flows to the engine and combustion begins. With the poppet valve 62 in its closed position as shown in FIG. 1, the increasing vacuum signal is not transmitted to the conduit 44 and thence to the EGR vacuum motor 20. This condition prevails until sufficient vacuum is present in the chamber 60 to create a differential pressure across the diaphragm 56 operative to compress the spring 66 and open the poppet valve 62. The fixed orifice 13 of orifice assembly 12 is sized to restrict flow from the chamber 60 to a rate which will delay the build-up of vacuum sufficient to open the poppet valve 62 for approximately 30 to 60 seconds to permit stabilization of engine operation after starting. With the poppet valve 62 open the EGR vacuum motor 20 may be actuated to open communication between the exhaust manifold and intake manifold.

The FIG. 2 Embodiment

The FIG. 2 embodiment normally operates to delay the beginning of operation of a vacuum actuated EGR valve in the same manner as the FIG. 1 embodiment. It provides an additional feature, however, in that it provides for substantially instantaneous resetting of the time delay apparatus to its rest position upon stopping of the engine, a feature that is particularly useful when a start is aborted for any reason.

Referring now to FIG. 2 wherein numbers like those of FIG. 1 refer to like parts, a time delay apparatus 210 is illustrated as comprising a time delay orifice assembly 212 fluidly connected to a vacuum source 214 and a vacuum relay valve assembly 216 disposed fluidly intermediate a vacuum source 218 and an EGR vacuum motor 220.

The FIG. 2 embodiment differs essentially from the FIG. 1 embodiment in that passage means 270 are provided for interconnecting the inlet port 228 and the downstream side 213A of the fixed orifice 213. A check valve 272 is positioned in the passage 270, protected by a filter 274 to permit flow from orifice downstream side 213A to the inlet port 228 only when the pressure at 213A exceeds that in port 228.

During starting and normal running of the engine the check valve 272 remains closed, resulting in operation identical to that described for the FIG. 1 embodiment, since after the time delay of 30 to 60 seconds the poppet valve 262 is fully open and no differential pressure exists across the orifice 213.

Upon stopping the engine, however, pressure at the intake manifold rapidly becomes equal to atmospheric pressure; but the pressure in the control chamber 260 of vacuum relay valve assembly 216 tends to lag in increasing because of the pressure drop across the orifice 213A. The check valve 272 prevents this lag by bypassing the orifice 213. The valve 272 is chosen to require little pressure differential for permitting flow from downstream side 213A to the inlet port 228. Thus, fluid at atmospheric pressure is rapidly ported to the control chamber 260 upon shutting down the engine; and the poppet valve 262 is reset to its closed position for repeat of its starting cycle function.

While the time delay apparatus of the present invention has been described in only two embodiments, others are possible to those skilled in the art without departing from the scope of the appended claims.

What is claimed is:

1. In a motor vehicle with an internal combustion engine having a controller valve for controlling the recirculation of exhaust gases from the exhaust manifold of the engine to the intake manifold thereof, the valve being of the type operated by a vacuum signal transmitted from a source within the engine through a flow conduit to the controller, a vacuum delay valve installed in the flow conduit intermediate the controller and the vacuum source for delaying the transmittal of the vacuum signal to the controller during the starting of the engine, the vacuum delay valve comprising:

A. vacuum relay valve means having;
   1. housing means defining an outlet port fluidly connected to said vacuum source and an inlet port fluidly connected to the controller;
   2. valve means disposed fluidly intermediate said inlet and outlet ports and moveable between a closed position preventing flow therebetween and an open position permitting flow;
   3. a signal conduit having a downstream end in fluid communication with said engine intake manifold and an upstream end;
   4. pressure responsive actuator means in fluid communication with said signal conduit upstream end for moving said valve means from said closed position to said open position in response to an increase in engine intake manifold vacuum above a predetermined level; and B. vacuum signal delay means comprising orifice means disposed in said signal conduit intermediate said engine intake manifold and said actuator means whereby movement of said valve means between said closed and open position is delayed a predetermined length of time.

2. A vacuum delay valve as defined in claim 1 and further comprising unidirectional valve means disposed fluidly intermediate said pressure responsive actuator means and a portion of said signal conduit intermediate said orifice means and said downstream end and operative to permit direct fluid communication between said intake manifold and said pressure responsive actuator means when the pressure in said intake manifold exceeds the pressure in said pressure responsive actuator means.

3. A vacuum delay valve as defined in claim 2 and further comprising filter means including a first filter carried in said signal conduit on the upstream side of said orifice means and a second filter carried in said signal conduit on the downstream side of said orifice means.

4. A vacuum delay valve as defined in claim 3 and further comrpising filter means disposed fluidly intermediate said unidirectional valve means and said signal conduit portion.

5. A vacuum delay valve as defined in claim 1 wherein said predetermined length of time is substantially in the range of 30 to 60 seconds.

6. A vacuum delay valve for delaying the transmittal of a vacuum source to vacuum operated EGR valve means for controlling the recirculation of exhaust gases between the exhaust and intake manifolds of an internal combustion engine, the vacuum delay valve comprising:

A. vacuum relay valve means having:

1. housing means defining an outlet port fluidly connected to said vacuum source and an inlet port fluidly connected to said EGR valve;
2. valve means disposed fluidly intermediate said inlet and outlet ports and moveable between a closed position preventing flow therebetween and an open position permitting flow;
3. a signal conduit having a downstream end fluidly connected to said engine intake manifold and an upstream end; and
4. pressure responsive actuator means in fluid communication said signal conduit upstream end for moving said valve means from said closed position to said open position in response to an increase in engine intake manifold vacuum above a predetermined level; and B. vacuum signal delay means comprising orifice means disposed in said signal conduit intermediate said engine intake manifold and said actuator means whereby movement of said valve means between said closed and open position is delayed a predetermined length of time.

7. A vacuum delay valve as defined in claim 6 and further comprising unidirectional valve means disposed fluidly intermediate said pressure responsive actuator means and a portion of said signal conduit intermediate said orifice means and said downstream end and operative to permit direct fluid communication between said signal conduit downstream end and said pressure responsive actuator means when the pressure in said signal conduit downstream end exceeds the pressure in said pressure responsive actuator means.

8. A vacuum delay valve as defined in claim 7 and further comprising filter means including a first filter carried in said signal conduit on the upstream side of said orifice means and a second filter carried in said signal conduit on the downstream side of said orifice means.

9. A vacuum delay valve as defined in claim 8 and further comprising filter means disposed fluidly intermediate said unidirectional valve means and said signal conduit portion.

10. A vacuum delay valve as defined in claim 6 wherein said predetermined length of time is substantially in the range of 30 to 60 seconds.

* * * * *